US009011303B2

(12) United States Patent
MacColl et al.

(10) Patent No.: US 9,011,303 B2
(45) Date of Patent: Apr. 21, 2015

(54) WHEELED EXERCISE DEVICE

(75) Inventors: Ian Coats MacColl, Mill Valley, CA (US); Tylor Hilton Garland, Studio City, CA (US); Jayson White Pegler, Moorpark, CA (US); George A. Clark, Lewis Center, OH (US); Alden Morris Mills, Kentfield, CA (US)

(73) Assignee: Implus Footcare, LLC, Durham, NC (US)

( * ) Notice: Subject to any disclaimer, the term of this patent is extended or adjusted under 35 U.S.C. 154(b) by 626 days.

(21) Appl. No.: 13/329,079

(22) Filed: Dec. 16, 2011

(65) Prior Publication Data

US 2012/0157274 A1 Jun. 21, 2012

Related U.S. Application Data

(60) Provisional application No. 61/424,049, filed on Dec. 16, 2010.

(51) Int. Cl.

| | |
|---|---|
| ***A63B 21/00*** | (2006.01) |
| ***A63B 21/045*** | (2006.01) |
| ***A63B 22/20*** | (2006.01) |
| ***A63B 21/02*** | (2006.01) |
| ***A63B 23/02*** | (2006.01) |

(52) U.S. Cl.

CPC ..... *A63B 22/203* (2013.01); *A63B 21/0004* (2013.01); *A63B 21/023* (2013.01); *A63B 21/045* (2013.01); *A63B 21/153* (2013.01); *A63B 23/0205* (2013.01); *A63B 2208/0219* (2013.01)

(58) Field of Classification Search

CPC ..... A63B 23/14; A63B 23/0205; A63B 23/0211; A63B 23/0216

USPC ..... 482/8, 92, 131, 132, 133, 135, 136, 482/140, 141, 902, 32, 51, 95, 96, 121, 126, 482/127; D21/662

See application file for complete search history.

(56) References Cited

U.S. PATENT DOCUMENTS

| | | | | |
|---|---|---|---|---|
| 1,824,920 | A | | 9/1931 | Novak |
| 2,131,570 | A | * | 9/1938 | Riley ..... 482/72 |
| 2,973,962 | A | | 3/1961 | Griffin |
| 3,403,906 | A | | 10/1968 | Burzenski |
| 3,752,475 | A | * | 8/1973 | Ott ..... 482/127 |
| 4,136,867 | A | | 1/1979 | Wilkin |
| 5,004,229 | A | | 4/1991 | Lind |
| 5,707,325 | A | | 1/1998 | Chiou |
| 6,017,296 | A | | 1/2000 | Tang et al. |

(Continued)

OTHER PUBLICATIONS http://www.merriam-webster.com/dictionary/wheel 2014 (c) Merriam-Webster, Inc.*

(Continued)

*Primary Examiner* — Oren Ginsberg
*Assistant Examiner* — Nyca T Nguyen
(74) *Attorney, Agent, or Firm* — Matthew J. Lattig; Charter IP, LLC

(57) ABSTRACT

A wheeled exercise device includes a first wheel part and a second wheel part coupled to the first wheel part, with the first and second wheel parts coupled together on a central axle therethrough so as to form a central main wheel with a generally flat center circumference and angled outer circumferential sides. The device includes a pair of handles, each handle extending outward and downward at an angle from the central axle from a corresponding wheel part.

10 Claims, 12 Drawing Sheets

(56) References Cited

U.S. PATENT DOCUMENTS

| | | | | |
|---|---|---|---|---|
| 6,053,853 | A | 4/2000 | Hinds | |
| D454,929 | S | 3/2002 | Huang | |
| 6,409,639 | B1 * | 6/2002 | Kuo | 482/140 |
| 6,500,105 | B1 * | 12/2002 | Kuo | 482/123 |
| 6,575,883 | B1 | 6/2003 | Hinds | |
| 6,585,627 | B2 * | 7/2003 | Fernandez | 482/140 |
| 6,761,611 | B2 * | 7/2004 | Wood et al. | 446/175 |
| 7,175,573 | B1 * | 2/2007 | Huang | 482/110 |
| D697,148 | S * | 1/2014 | Lin | D21/681 |
| 2002/0123416 | A1 * | 9/2002 | Huang | 482/140 |
| 2003/0032536 | A1 | 2/2003 | Mabe, Jr. et al. | |
| 2003/0134716 | A1 * | 7/2003 | Yu | 482/44 |
| 2003/0158023 | A1 * | 8/2003 | Yu | 482/126 |
| 2011/0275482 | A1 * | 11/2011 | Brodess et al. | 482/8 |

OTHER PUBLICATIONS http://www.merriam-webster.com/dictionary/clutch 2014 (c) Merriam-Webster, Inc.* http://www.merriam-webster.com/dictionary/actuator 2014 (c) Merriam-Webster, Inc.*

* cited by examiner

WHEELED EXERCISE DEVICE

PRIORITY STATEMENT

The present application claims the benefit under 35 U.S.C. §119(e) of U.S. Provisional Patent Application Ser. No. 61/424,049 to MacColl et al., filed Dec. 16, 2010 and entitled "WHEELED EXERCISE DEVICE", the entire contents of which is hereby incorporated by reference herein.

BACKGROUND

1. Field

Example embodiments in general are directed to a wheeled exercise device, more particularly a wheel exercise device including handles for performing abdominal or core exercises.

2. Related Art

A number of hand-grasped, wheeled exercisers are known in the art. A conventional device comprises a roller/wheel mounted centrally on a shaft, with the shaft having gripper members on opposite ends. As a force is applied to the gripper members to rotate the wheel/roller along a surface, the user may conduct an exercise, such as an exercise for the abdominal or core region of the body.

Another conventional wheeled exercise device employs coil springs to provide resistance and restoring forces. Known commercially as the AB SLIDE™ slider roller, this device is a wheeled abdominal exerciser with handles, which through internal coil springs generates resistance in moving the exerciser forward, and also generates a restoring force after traveling forward to a desired position, so as to lessen the manual effort required to move the wheeled exerciser backward to its original starting position.

The AB SLIDE™ is arranged with two main traction wheels and two auxiliary wheels pivoted on a housing having handles protruding perpendicularly from the vertical sides thereof. One or two springs are used to provide a restoring force against forward movement of the exerciser. One end of each spring is fixed to the housing of the exerciser and another end of the spring is attached to a main traction wheel of the exerciser. Bearings are used to provide some friction on the main traction wheels when the user presses them against the floor or the ground.

Other conventional hand-grasped wheeled exercisers either require the user to hold the handles firmly against the restored turning force of the spring(s) or have the storing force of the spring(s) transmitted through a set of gears which may tend to reduce the effectiveness of the restoring spring force. Many conventional wheeled exercisers have one or more non-optimal characteristics, such as being cumbersome, costly, unstable, complex and/or otherwise non-optimal. Very little effort has been made in addressing the ergonomic design of the handles or design of the roller/wheel in these wheeled exercises devices, nor has there been significant implementation of electronics or software processing therein which provide real-time visual feedback of progress during exercise in such wheeled exercise devices to the user.

SUMMARY

An example embodiment is directed to a wheeled exercise device. The device includes a first wheel part, a second wheel part separate from the first, and a band coupled between the first and second wheel parts. The first wheel part, band and second wheel part are coupled together on a central axle therethrough so as to form a central main wheel with a generally flat center circumference and angled outer circumferential sides. The device includes a pair of handles, each handle extending outward and downward at an angle from the central axle from either side of the main wheel.

Another example embodiment is directed to a wheeled exercise device having a first wheel part, a second wheel part separate from the first, and a band coupled between the first and second wheel parts. The first wheel part, band and second wheel part are coupled together on a central axle therethrough so as to form a central main wheel with a generally flat center circumference and angled outer circumferential sides. The device includes a resistance mechanism for imparting resistance to rotation of the main wheel during exercise in one direction and assistance to the exerciser in another wheel direction, and a pair of handles, each extending from a respective side of the main wheel.

Another example embodiment is directed to a wheeled exercise device having a first wheel part, a second wheel part separate from the first, and a central band coupled between the first and second wheel parts, the band configured so as to see objects and images therethrough. The device includes an electronics module for providing data related to a workout and the module to a user, and a pair of handles, each handle extending from a corresponding wheel part.

Another example embodiment is directed to a wheeled exercise device having a first wheel part, and a second wheel part coupled to the first wheel part, with the first and second wheel parts coupled together on a central axle therethrough so as to form a central main wheel with a generally flat center circumference and angled outer circumferential sides. The device includes a pair of handles, each handle extending outward and downward at an angle from the central axle from a corresponding wheel part.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

As to be described in further detail hereafter, the example embodiments are directed to a wheeled exercise device having a pair of circular overmold tires or wheel parts bounding a central display band therebetween that together form a central wheel. A pair of handles flair at an angle outward and downward from a corresponding central axis from either side of the central wheel. The device thus provides a wheel having a contiguous central flat portion and curved side portions for carving along a surface so as to exercise the abdominal or core regions of the body.

As to be shown hereafter, each handle includes an ergonomic handle or gripping surface flared down from a support structure, in an example a handle support tube coupled to an axle which extends through the center wheel formed by the pair of wheel parts sandwiching the display band.

Additionally, the device includes tensioning means and/or a resistance mechanism for imparting resistance to the exerciser using the device with wheel rotation in one direction, while imparting a restoring force so as to assist the exerciser with wheel rotation in an opposite direction. In an example, the resistance mechanism may be embodied by an internal spring assembly which may or may not interface a clutch. In the embodiment with a clutch, the clutch may be engaged/disengaged by manual switches on the outside of the wheel facing to provide resistance to axle/wheel motion.

Further, and as to be described in more detail hereafter, the device is configured with a removable, self-powered electronics module supporting a microprocessor supplied by microchip. The electronics module includes sensors recording workout and device data during exercise, data which can be displayed for review by the user.

Figure 1:
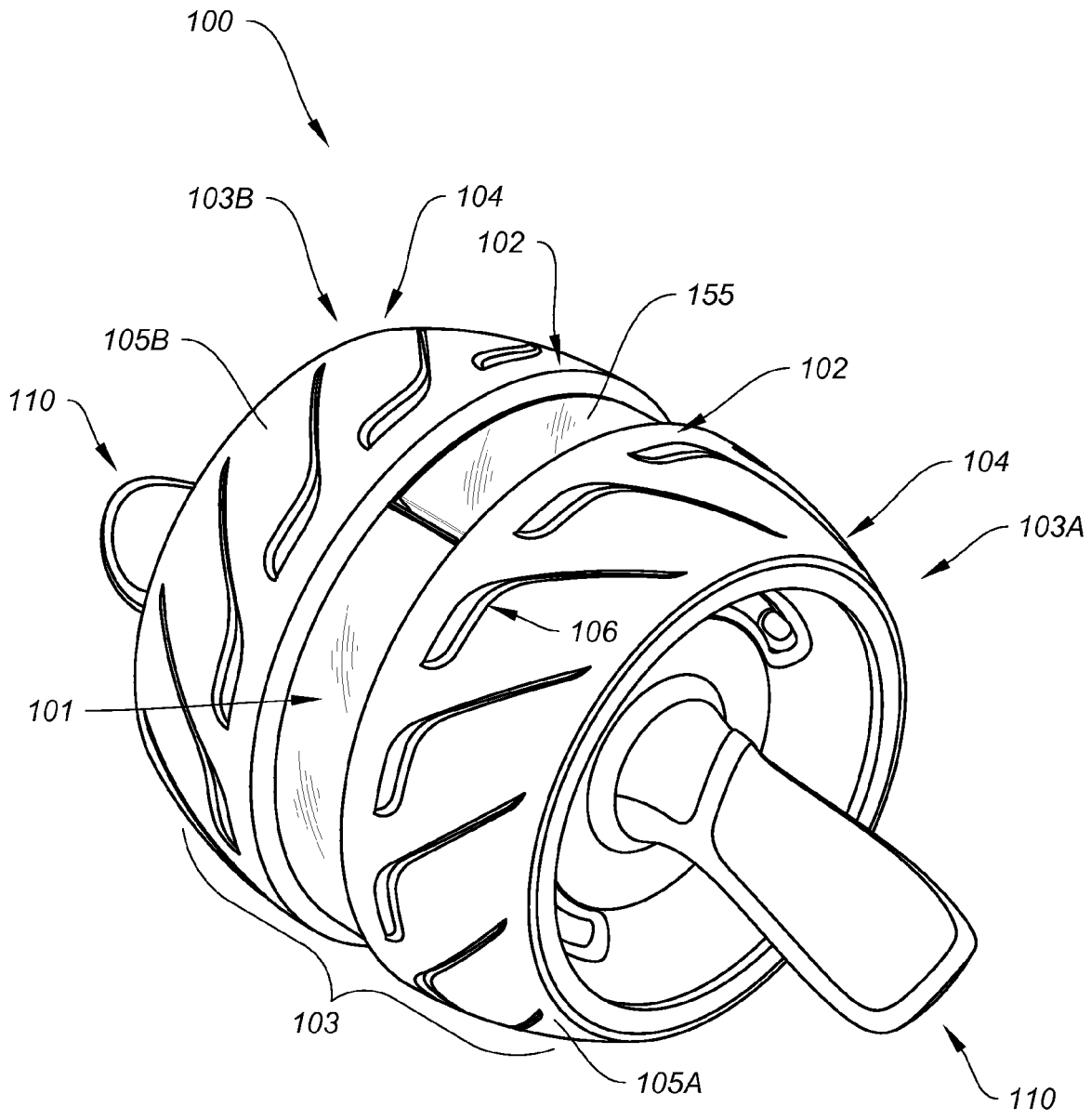
FIG. 1 is a front perspective view of a wheeled exercise device in accordance with an example embodiment.
Figure 2:
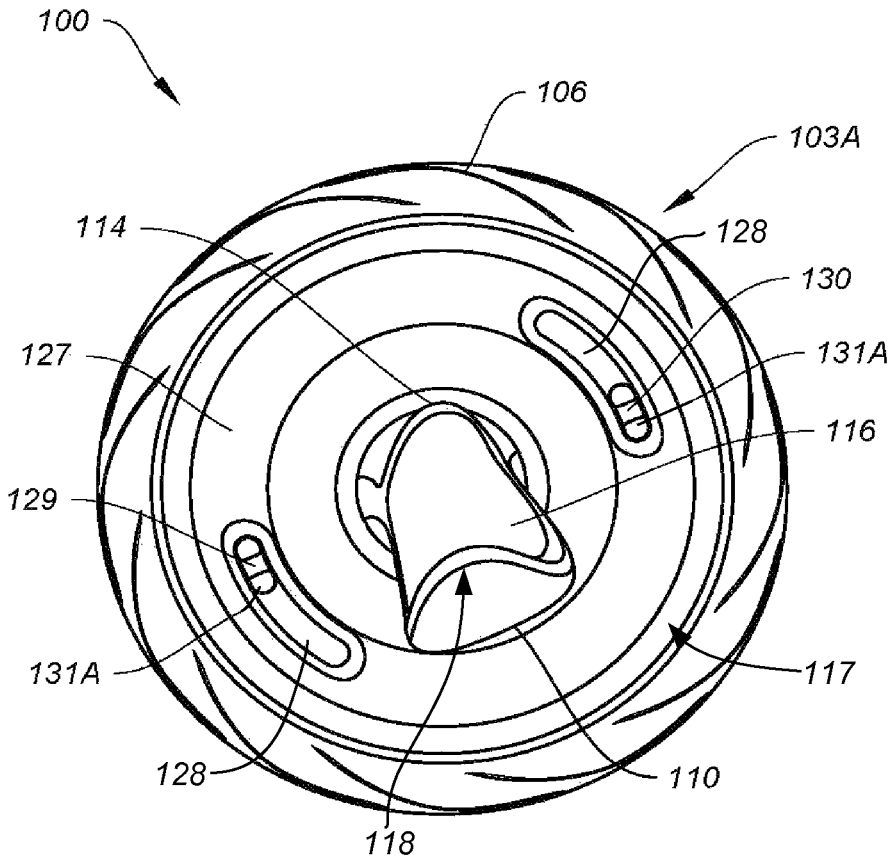
FIG. 2 is a left side elevational view of the device in FIG. 1.

FIG. 1 is a front perspective view of a wheeled exercise device in accordance with an example embodiment; FIG. 2 is a left side elevational view of the device in FIG. 1.

The wheeled exercise device, hereafter "device 100" includes a central main wheel 103 which that includes a left-hand angled or curved wheel part 103A, a right-hand angled or curved wheel part 103B and a central, display band 101 positioned between the wheel parts 103A and 103B. The display band 101 may be clear or colored but translucent, so as to be able to see through to visually view digital numbers and data, or to receive projected digital data thereon regarding information related to a workout during exercise or other parameters of a removable electronics module (not shown).

A central shaft or axle (not shown) extends through the main wheel 103 and connects a pair of handles 110 at ends thereof. In an example, each handle 110 is oriented downward from a central axis of each wheel part 103A/B, such as in the fashion of a pilot's steering mechanism on an aircraft, for example. The downward, outward orientation of the handles 110 may reduce the stresses imparted to the wrists and shoulders during abdominal or core exercises when using the device 100. The concept is that since the user engages more of the triceps muscles by holding the handles 110 at an angle, the user may have additional strength to hold on to the device 100 as compared to a case where the handles 110 extend directly straight out from the center of each wheel part 103A/B. Additionally, and as shown in FIG. 2, the distal end of each handle 110 terminates in a ridge 118.

In operation, a user may place their hands on the handles 110 and extend their body outward left, straight out or right to work abdominal/oblique regions. The left or right motion may be referred to as carving, such as is known in the snowboard or skateboard regimens for example. Each of the wheel parts 103A and 103B has a flat surface portion 102 that abuts the edge of the display band 101, and a carving surface 104 that falls over toward each far edge. Each wheel part 103A, 103B also has a wide profile to mimic that of a "fat motorcycle tire" and also to aid in stability, and includes a corresponding tire overmold 105A, 105B with treads 106 formed therein. The curved nature of the carving surfaces 104 on the left and right wheel parts 103A and 103B facilitates this carving exercise action, which can work the back, side, quad/glute and abdominal muscle groups on either side of the body.

In an example, the handles 110 may be removable such as for replacement by other accessories and/or for stowage of device 100 such as for travel. In lieu of handles 110, the axle of device 100 may be configured for one or more of the following: knee drop accessory attachment with hands on the floor; feet accessory attachment to the axle; elbow drop in accessory to the axle; knee pad accessory.

As to be described in further detail hereafter, in one example, device 100 may be configured to provide a resistance to rotation of the wheel 103. In this example, such may be realized as a fixed tension applied to the axle 140 against the rotation thereof, such as by spring pressure imparted by one or more springs for example. No tension can be applied, or set tensions at a desired force (e.g., 5, 10 or 15 ft-lb, etc. of force) may be set. In another example, the tension may be fixed or variable, as selected or set by the user thereof.

In one example, the tension may be applied by way of constant spring pressure, with no clutch mechanism employed. In another example, a single clutch mechanism may be employed to engage or disengage frictional resistance in the device 100. In a further embodiment, multiple clutch mechanisms may be employed to vary the resistance against wheel 103/axle 140 rotations within device 100.

As shown best in FIG. 2, each handle 110 may include an ergonomic hump 114 and have its upper part covered with an overmold grip 116 that may be composed of TPE for example. The hump 114 separates the thumb from fingers and may also assist in reducing the stress on the hands and wrist. FIG. 2 also illustrates one example of a clutch mechanism used in conjunction with device 100. A clutch assembly may include manual actuators 129 and 130 which protrude from a rotatable primary switch 131A that abuts a rear side of the wheel facing 127 of wheel part 103A. Manual actuators 129, 130 are constrained within a slot 128 of the wheel facing 127 (similar for wheel part 103B). In general, the actuators 129, 130 of the primary switch 131A may be actuated to engage or disengage a clutch mechanism to impart (or release) a resistive force against the direction of forward rotation of the central wheel 103.

As to be described in further detail hereafter, device 100 includes an electronic module (hereafter "module 190") configured to track certain user information, display certain system and user information and to interact with certain sensors. The module 190 may be removably supported within the device 100 as to be shown hereafter. In one example, module 190 may be configured to detect device 100 movement so as to energize and turn on, so as not to drain internal system power.

As to be described in further detail hereafter, the module 190 controls a display, which in one example may be projected onto the display band 101 and in another embodiment may be a back lit LED that can be viewed through the display band 101. Additionally, the module 190 may be configured so that a user may be able to retrieve data therefrom or import data thereto. In an example, the module 190 may be configured to interface with any well known and/or developing data storage devices or cards, including those passing data by wired, wireless/Bluetooth interfaces, smart card and/or QR code technologies, for example.

Figure 3:
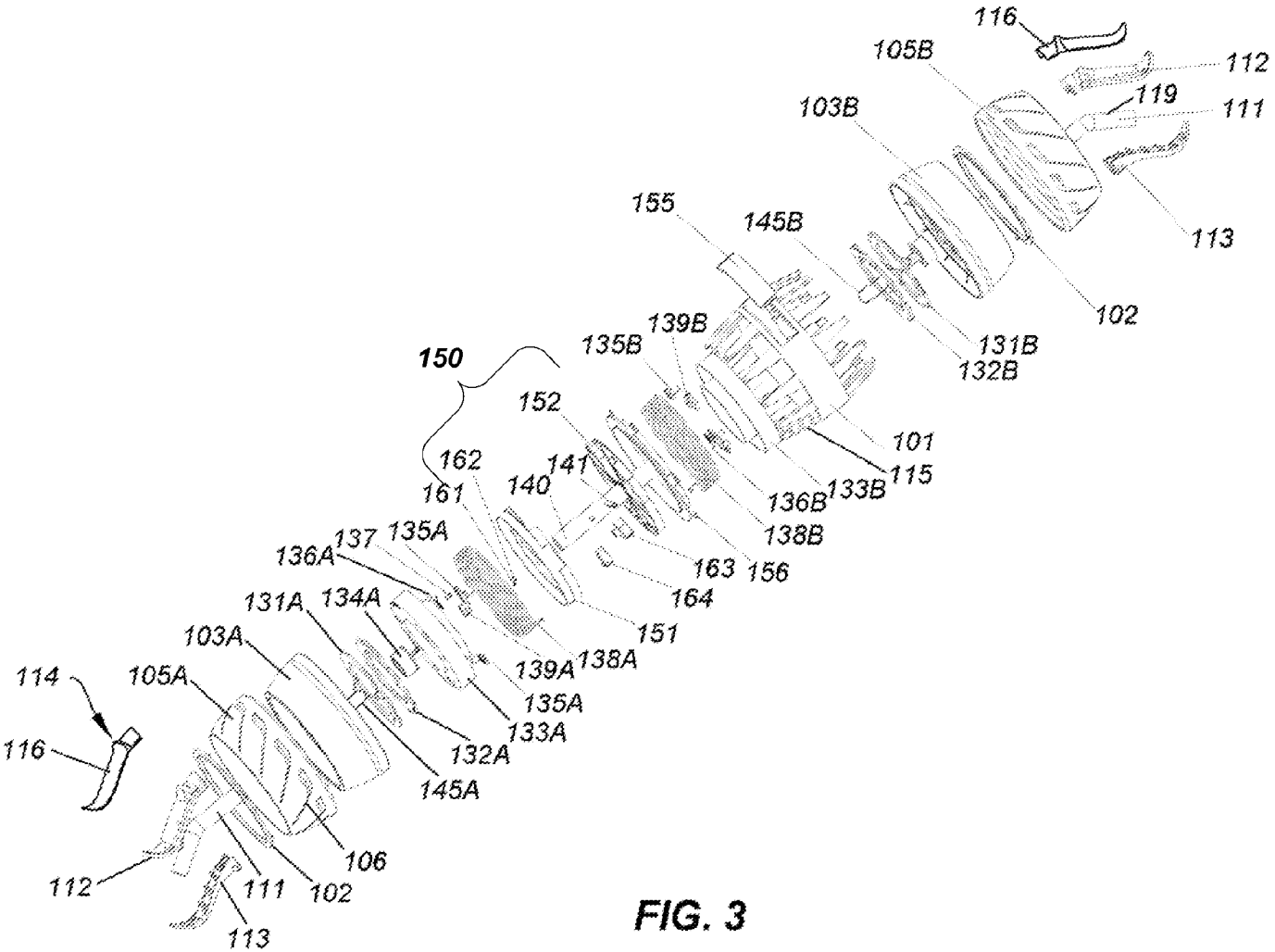
FIG. 3 is an exploded view of the device in FIG. 1 to show the constituent parts thereof in more detail.
Figure 4:
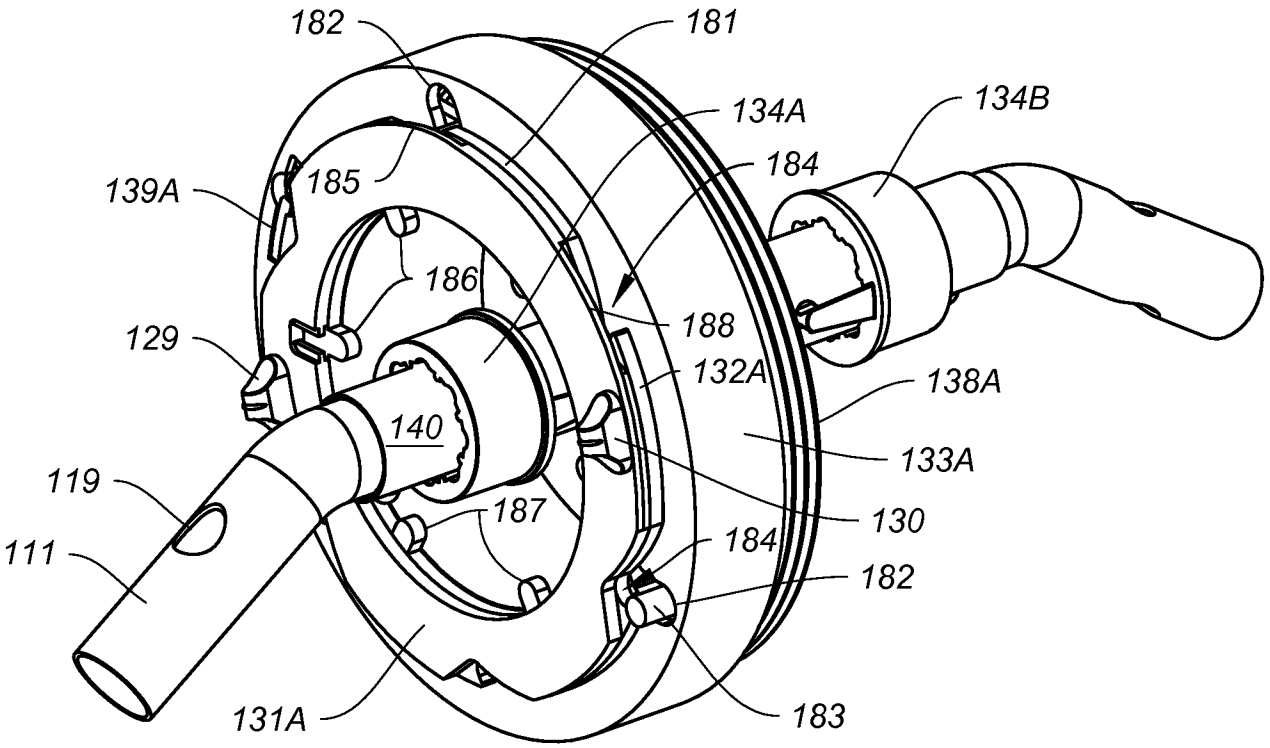
FIG. 4 is a partial cutaway perspective view from the left side with all components removed except selected components to illustrate clutch operation from the left side clutch of the device.

FIG. 3 is an exploded view of the device in FIG. 1 to show the constituent parts thereof in more detail. FIG. 4 is described initially looking at the constituent components to the left of module access door 155. Unless otherwise noted, many of the components on the left side have mirror image parts on the right side of access door 155. Occasional reference is made to both sides.

Referring to the left side, each handle 110 may be composed of a support tube 111 that is attached to the axle 140, with an upper half molded handle part 112 and lower half molded handle part 113 encompassing the support tube 111. In an example, the support tube may 111 be formed of a metal such as steel and each handle part of a tough plastic such as polypropylene, for example.

Each wheel part 103A/B may be formed of a hard plastic such as TPE or polypropylene and include a corresponding tire overmold 105A/B made of PET for example having treads 106 formed therein. Left hand tire overmold 105A fits over left wheel part 103A; right hand tire overmold 105B fits over right wheel part 103B. Each wheel part 103A/103B may include a decorative (optional) trim cap 117 (see FIG. 2) applied thereon. Trim cap 117 may be plastic (polypropylene) with labeling and/or product information on an outer circumference thereof.

A center hoop 115 includes the display band 101 with removable access door 155 and is situated between the wheel parts 103A, 103B. One side of the center hoop 115 terminates as a right clutch 133B.

Referring to the left side of FIG. 3, a first clutch assembly may include the aforementioned left primary switch 131A with its actuators 129, 130 protruding through the slot 128 in wheel facing 127 as shown in FIG. 2. The left (rotatable) primary switch 131A cooperates with a left (fixed) secondary switch 132A, each of which bear against a first clutch 133A. A left shaft bearing 134A rides on the central axle 140 and provides a mechanism to permit smooth rotation of the left wheel part 103A on axle 140 with a low coefficient of friction. Shaft bearing 134A may be configured as a Dekin® bushing for example. The axle 140 includes a steel pin 141 which serves to prevent an electronics support housing 150, (hereafter "hub 150") comprising left module support half 151 and right module support half 152 from rotating on axle 140.

The rear of first (or left) clutch 133A has a plurality of latches 135A attached around an outer circumferential periphery thereof (only one latch 135A shown for clarity). Each latch is biased by a corresponding latch spring 136A. These latches 135A interact with the switches 131A and 132A as to be described in more detail hereafter. One end of first spring 138A is secured to first clutch 133A by a spring clip 139A and screw 137. The other end of first spring 138A is secured to axle 140 via the hub 150 that is connected thereto, specifically by being connected to the left module housing support half 151 by a spring clip 164 through detent spring 161 and detent block 162. As to be described in more detail hereafter in one example embodiment, the spring 138A serves as a resistance mechanism for imparting frictional resistance to rotation of the left wheel part 103A (or main wheel 103 in a single spring or single clutch embodiment) during exercise, with the clutch 133A engaged via manual actuators 129/130. In another example without a clutch 133A or manual actuators 129/130, the spring 138A may be coupled between the axle 140 and a wheel part 103A/B to provide a constant frictional resistance to rotation of the main wheel 103 in the forward direction during exercise.

Referring to the center of FIG. 3, the hub 150 is composed of a left module support half 151 and a right module support half 152 which abuts a light ring 156. The light ring 156 is attached to the right wheel part 103B and rotates with axle 140 rotation. When the two halves 151/152 are connected together, an aperture (not shown) is formed for receiving the electronics module 190 therein. The pair of spring clips 164 and 163 may be employed for attaching left spring 138A to left module support half 151 and right spring 138B to right module support half 152 respectively.

Both sides include handle locks 145A and 145B which fit within and between axle 140 and inner tubes 111. One end of each handle lock 145A/B fits within a corresponding end of axle 140. The other end of handle lock 145 A/B has a spring—biased detent (not shown) that captures a bore 119 formed in the corresponding handle tube part 111 to lock the handle tube part 111 to the handle lock 145A/B and hence axle 140.

Referring now to the right hand side of FIG. 3, the second clutch assembly is similar to the first, including a right shaft bearing 134B riding over axle 140 through primary and secondary switches 131B, 132B. The right spring 138B bears against a facing surface of the right module support half 152 on one side, with the other side of right spring 138B bearing against a surface of a second (or right) clutch 133B. As with spring 138A, spring 138B serves as a resistance mechanism for imparting frictional resistance to rotation of the right wheel part 103B (or main wheel 103 in a single spring or single clutch embodiment). The rear of second clutch 133B has a plurality of latches 135B attached around an outer circumferential periphery thereof (only one latch 135B shown for clarity). Each latch 135B is biased by a corresponding latch spring 136B. These latches 135B interact with the switches 131B and 132B as to be described in more detail hereafter. A spring clip 139B secures one end of right spring 138B to the right clutch 133B. The other end of right spring 138B is secured to axle 140 via right module support half 152 by spring clip 163. Accordingly, each spring 138A, 138B is connected between the axle 140 and a respective clutch 133A/B.

Although FIG. 3 has illustrated a device 100 with a pair of clutch assemblies or mechanisms, engage able on the outside wheel facings 127 by manual actuators 129, 130. However, the device 100 shown in FIGS. 1-3 may in fact be configured with no clutch but simply a constant frictional force, such as is imparted by a spring 138A/B against forward rotation of wheel parts 103A/B, a single clutch (either clutch 133A or clutch 133B), and/or multiple clutch mechanisms (i.e., >2 as shown in FIG. 3).

Additionally, although FIG. 3 has shown separate wheel parts 103A and 103B, and a central band 101 as part of a loop 115, the device 100 in another configuration could have the band 101 formed as part of wheel part 103A or 103B. Alternatively, in an embodiment without a clutch 133A/B or electronics module 190, parts 103A, 101 and 103B could be formed from a single molded piece as a main wheel 103, with overmold trim parts 105A/B applied thereon.

Figure 5:
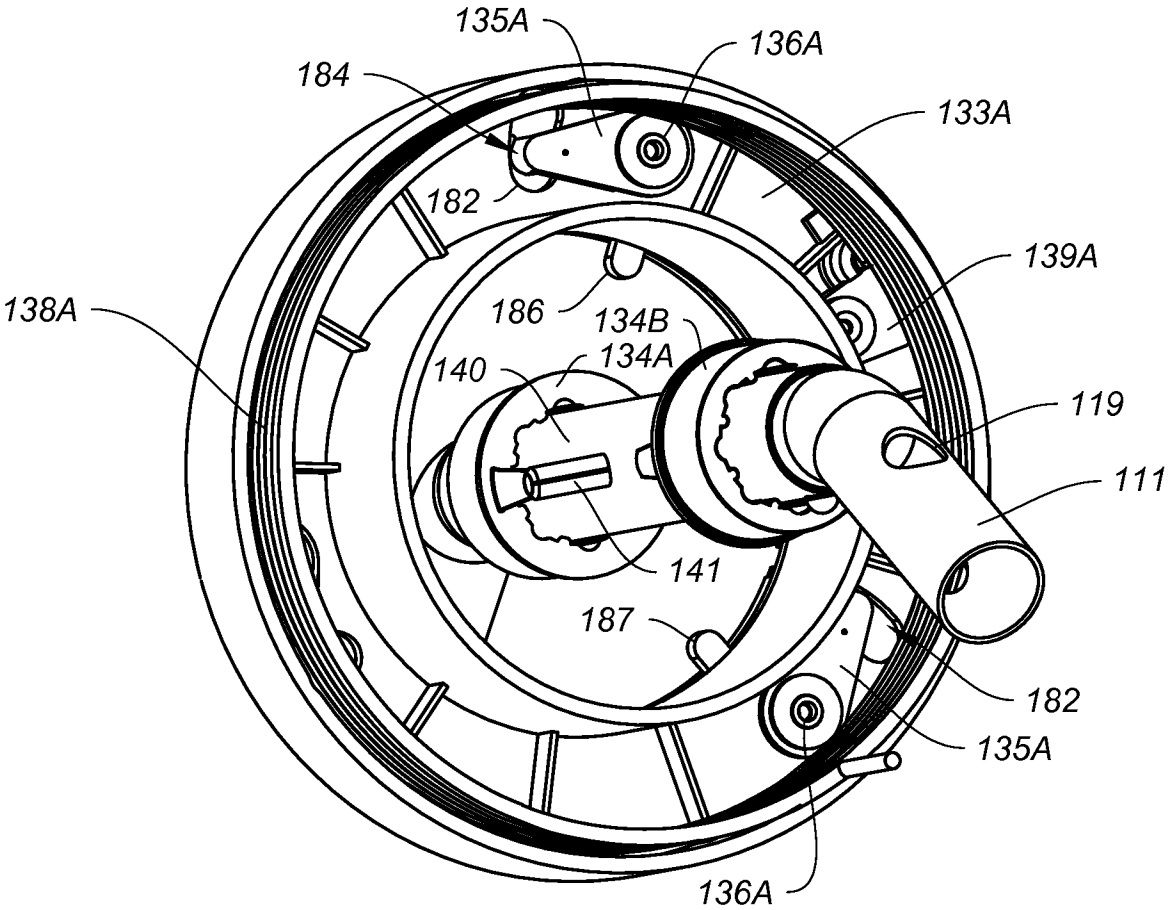
FIG. 5 is a partial cutaway perspective view from the right side with all components removed except selected components to illustrate clutch operation from the left side clutch of the device.

FIG. 4 is a partial cutaway perspective view from the left side with all components removed except selected components to illustrate clutch operation from the left side clutch of the device; and FIG. 5 is a partial cutaway perspective view from the right side with all components removed except selected components to illustrate clutch operation from the left side clutch of the device.

FIGS. 4 and 5 are provided to better illustrate internal clutch operation on the left side of device 100; the operation on the right side of the device 100 in a two-clutch mechanism embodiment or in a single-clutch embodiment being the same.

In one example, and referring initially to FIG. 2, the manual actuators 129, 130 work in concert and have two (2) positions, engaged and disengaged. In an alternate example embodiment, a device 100 may be provided without manual actuators 129, 130 to have a single, engaged clutch with fixed tension. In a further example, device 100 can be configured to have no clutch, but simply may impart a constant resistance to the forward direction of rotation of the main wheel 103 during exercise. This may be embodied by one or more tension springs (such as 138A/B) that is coupled between the axle 140 and one or both wheel parts 103A/B.

Referring to FIGS. 4 and 5, the device 100 is shown with the actuators 129/130 "engaged", i.e., the left clutch 133A is engaged to left wheel part 103A so as to provide frictional resistance along with its connected first spring 138A. In a single clutch embodiment, this may be the only clutch engaged, whether or not the primary switch 131A includes manual actuators 129, 130 or a fixed resistive force is set without manual override; in a dual clutch embodiment as shown in FIG. 3, both clutches 133A, 133B may be engaged via actuators 129/130 on either side of wheel facings 127.

In this configuration, the primary switch 131A has been rotated counterclockwise, such that it has become offset from secondary switch 132A, exposing a series or ramps 181 and ratchet teeth 184 of the secondary switch 132A. In the disengaged position, with the primary switch 131A rotated slightly clockwise within slot 128 (see FIG. 1) via actuators 129/130, these ramps 181 and teeth 184 align in between corresponding gaps (shown generally by arrows 185 and 188) so that the two switches 131A, 132A complement and align to each other, permitting the clutch 133A with its pins 183 to freely rotate so as not to engage the first spring 138A.

Figure 6:
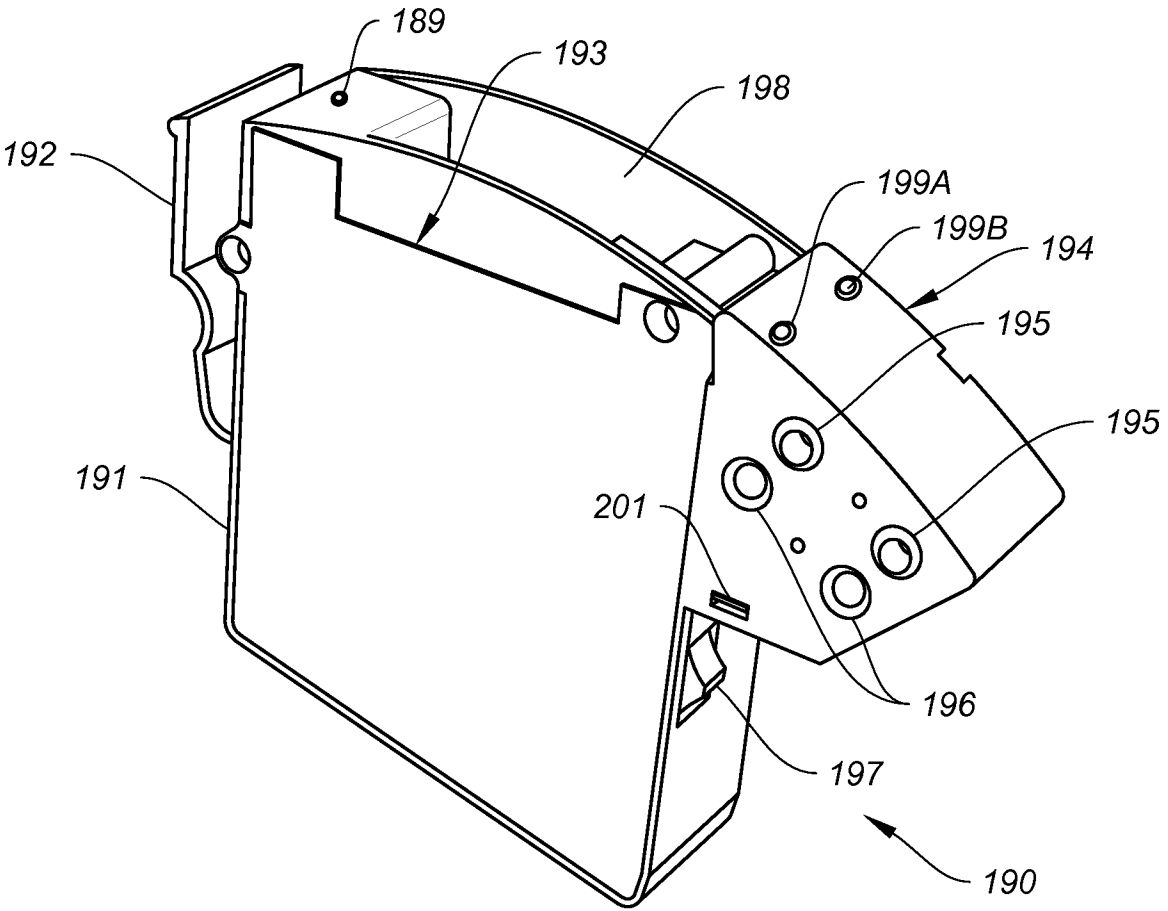
FIG. 6 is a perspective view of the electronics module according to an example embodiment.

However, by moving the actuators 129/130 counterclockwise, the primary switch 131A thus rotates and becomes offset from the secondary switch 132A, exposing the ramps 181 and ratchet teeth 184 so as to engage the clutch pins 183 of the clutch 133A. As can be seen in FIG. 6, each pin 183 is part of latch 135A that is spring biased by latch spring 136A through a bore 182 in the clutch 133A. These pins 183 engage the ratchet teeth 184 of the secondary switch 132A. Since the secondary switch 132A is attached to the left wheel part 103A via detents 186 and 187 in the connected configuration, the clutch and spring action is imparted to the forward wheel movement so as to provide resistance. To prevent the spring 138A from becoming bound up during left wheel part 103A rotation, the pin 183 rides up the ramp 181 and is caught in the next ratchet tooth 184, and so on, etc. Spring clip 139A secures one end of spring 138A to clutch 133A, the other end being secured to the hub 150 on the axle 140 (left module support half 151), not shown in these figures for clarity. The steel pin 141 prevents the hub 150 from rotating on axle 140, and the shaft bearings 134A/B permit smooth rotation of the wheel parts 103A and 103B on axle 140 with a low coefficient of friction.

The springs 138A/B store potential energy as they become compressed/stretched or deformed during forward wheel rotation, exerting a resistive force against forward wheel rotation that is transmitted to the axle 140 and wheel parts 103A/B. But on the reverse rotation of device 100 back to the original position, the springs 138A/B release this potential energy to provide a restoring force which acts to assist the exerciser in rolling the device 100 back to the original, starting position of the exercise. Thus, the resistance mechanism described herein can be said to impart resistance to rotation of the main wheel 103 during exercise in one direction (i.e., forward direction), but provide assistance to the exerciser in another (i.e., the opposite or reverse) wheel direction.

FIG. 6 is a perspective view of the electronics module according to an example embodiment. Referring to FIG. 6, the removable electronics module 190 may include a body or housing 191 which in an example may be made of a hard plastic or thermoplastic such as ABS, TPR or polypropylene, for example. The rear of module 190 is provide with a flexible thumb latch 192 that facilitates locking and removal of the module 190 into and out of an aperture 153 (not shown) created between the module support halves 151, 152. The two halves 151, 152 thus form the hub 150 which is attached to axle 140 and which is prevented from rotating with the wheel parts 103A/B by pin 141. The latch 192 interfaces with ribbed detents (not shown) located in the aperture 153 to form an interference fit with the access door 155 open, as is known), and with the access door open 155 can be pressed inward to separate the thumb latch 192 from the detents in order to remove the module 190 out of aperture 153.

The housing 191 includes a power source compartment access 193 which houses a power source. Module 190 may be powered by a suitable rechargeable battery pack (NiCd, NIMH and/or Li-ion) or one or more non-rechargeable batteries, for example.

Element 194 indicates the general location of the internal microprocessor. The microprocessor 194 may be embodied as a microchip and included associated storage elements therein for storing various system parameter data. The storage elements, memory or storage medium may be part of the microchip or a separate storage element in communication therewith.

The microprocessor 194 includes circuitry to detect movement for power on and timing circuitry to power off display and main power. For example, microprocessor 194 includes a movement sensor (not shown, provided on the PCB) that powers on the module 190 after it has detected sustained wheel movement (multiple rotations) on the device 100. Additionally, microprocessor 194 includes timing circuitry on the PCB that detects the absence of movement to begin powering down display electronics (such as LED elements) and then main power after an absence of movement has been determined for a specified period of time. The thresholds for power on and power off may be coded in software at time of manufacture, as is within the skill of the art. In a specific example, the module 190 may also be designed to time out after a preset time of non-use, i.e., 5 minutes, so as to conserve main power.

Aperture 198 represents an area for display. The module 190 may be configured with a custom back lit LCD or LED display in the area filling aperture 198. In this example, the back-lit display filling aperture 198 may include a plurality of LED segments, at least up to 96 segments, for easy of view in roughly a 1" by 3" viewing screen on the module 190 through the display band 101.

In another example, the electronics module 190 may be configured to interface with an LED projector unit so that all information is displayed on the display band 101. In this example, the projector unit fills aperture 198 and may be embodied by a super bright 3V LED light source, providing approximately a 1"×3" active display area that is projected on the display band 101. Various types of information may be displayed for review by the user on display band 101 (via the projection unit in aperture 198, or back lit LED display in aperture 198).

In an example, the electronics module 190 is configured to receive future software/firmware updates via PC. Accordingly, module 190 may be configured with an output port such as USB port 201, or other similar interface to connect it to a remote device (wired and/or wireless) to move data thereto, such as to a user account, in one example. Instead of or in addition to a USB port 201, device 100 may include wireless transceiver circuitry, shown by wireless indicator 189 thereon.

Device 100 is configured with a multi-sensor system which is in communication with the microprocessor 194 of module 190 to calculate certain data of interest. In an example, this may include LED emitters 195 (primary) and a secondary set of LED receivers 196. Operation of how data is measured and recorded with regard to distance and repetitions are described in more detail hereafter. An on/off switch 197 may optionally be provided.

In another example, the primary sensor system may be embodied by a Holoflex® sensor; a ¼" magnetic strip with polarity change minimum every ¼". The strip may be bonded and/or tabbed into the inner circumference of the wheel parts 103A/B. As the wheel 103 rotates backwards or forward, the Holoflex® sensor may measure incremental rotation in both directions; this is communicated to the microprocessor in module 190.

Further, module 190 may include two tilt switch sensors 199A and 199B that individually can determine preset angles (i.e., carving left or carving right) on the left and right sides as well as upside-down and right side up. These tilt switch sensors 199A and 199B facilitate in sensing optimal tilt on the device 100 to engage oblique abdominal muscles. When tilted to the left or right, a progress bar on a display provided by module 190 will respond accordingly. In another example, the device 100 will "wake up" via a state change detected in one or both of tilt switches 199A/B. In another example, the one or both of the tilt switch sensors 199A/B may also be used as a soft reset for the electronics when the device 100 is turned upside down.

Figure 7:
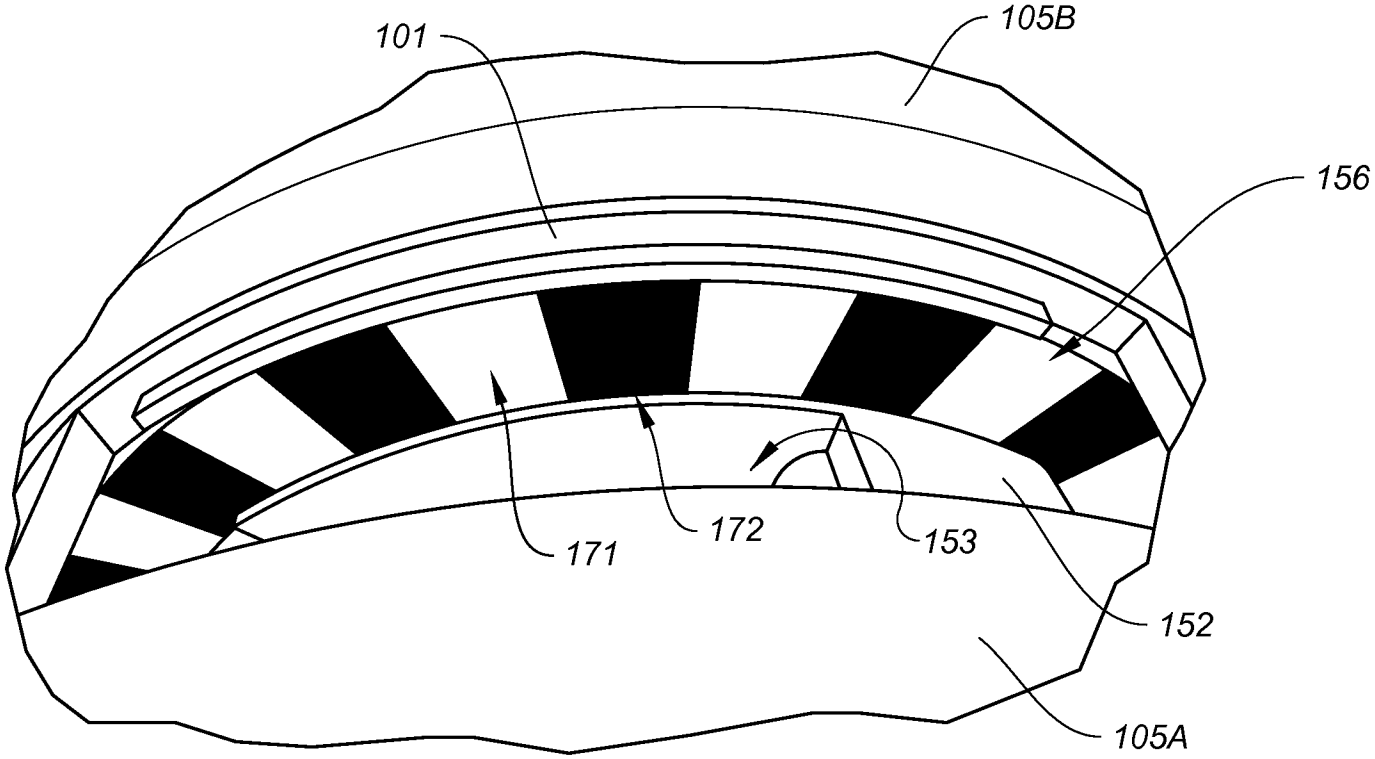
FIG. 7 is a partial top perspective view of the device with the electronics module removed to illustrate a portion of the light wheel in more detail.

FIG. 7 is a partial top perspective view of the device with the electronics module removed to illustrate a portion of the light wheel in more detail. The primary LED emitters 195 (primary) and a secondary set of LED receivers 196 are employed in conjunction with the light wheel 156 in order to provide data for the microprocessor 194 to calculate or determine distance, direction and repetitions for example.

As shown in FIG. 7, with the access door 155 removed from the display band 101 and the module 190 removed from the aperture 153 formed in the hub 150 that is fixedly connected to axle 140 (only a portion of the right module support half 152 being shown), the light wheel 156 can be more clearly seen adjacent and attached to the tire overmold 105B of the right wheel part 103B. Occasional reference should be made to FIG. 6 for the following discussion.

The light wheel 156 includes a plurality of alternating reflecting (light or "1") segments 171 and absorbing (dark or "0") segments 172 on a circumferential edge surface thereof. The use of two pairs of LED emitter/receivers 195/196 facilitates determining whether the direction is forward or reverse. Each LED emitter 195 sends out a light signal that reflects off reflecting segment 171 and is captured by its corresponding receiver 196 as a "1", then a zero for the dark segment 172, alternating back and forth, etc. So in the forward direction, the front receiver 196 receives the first "1" than the first "0", the second or rear receiver receives the second "1" and the second "0" and so on, indicating to the processor that the wheel 103 is being rotated in the forward direction and counting the number of "1" and "0" pairs which equates to a full revolution (coded in software and set to a foot length, in one example). As the user travel backwards with device 100 back to the original position, the rear or now "first" receiver 196 receives the first "1" than the first "0", the "second" or front receiver receives the second "1" and the second "0" and so on, indicating to the processor that the wheel 103 is being rotated in the backward direction and counting the number of "1" and "0" pairs which equates to a full revolution. Software in the microprocessor 194 determines when the number of forward and backward revolutions equate to a complete "repetition" and increments that (such as in a separate counter, for example). Software in the microprocessor also aggregates the total distance traveled (forward and back) in a separate counter, for example. Distance and revolution parameters may be accessed by the user on the display for visual review.

Figure 8:
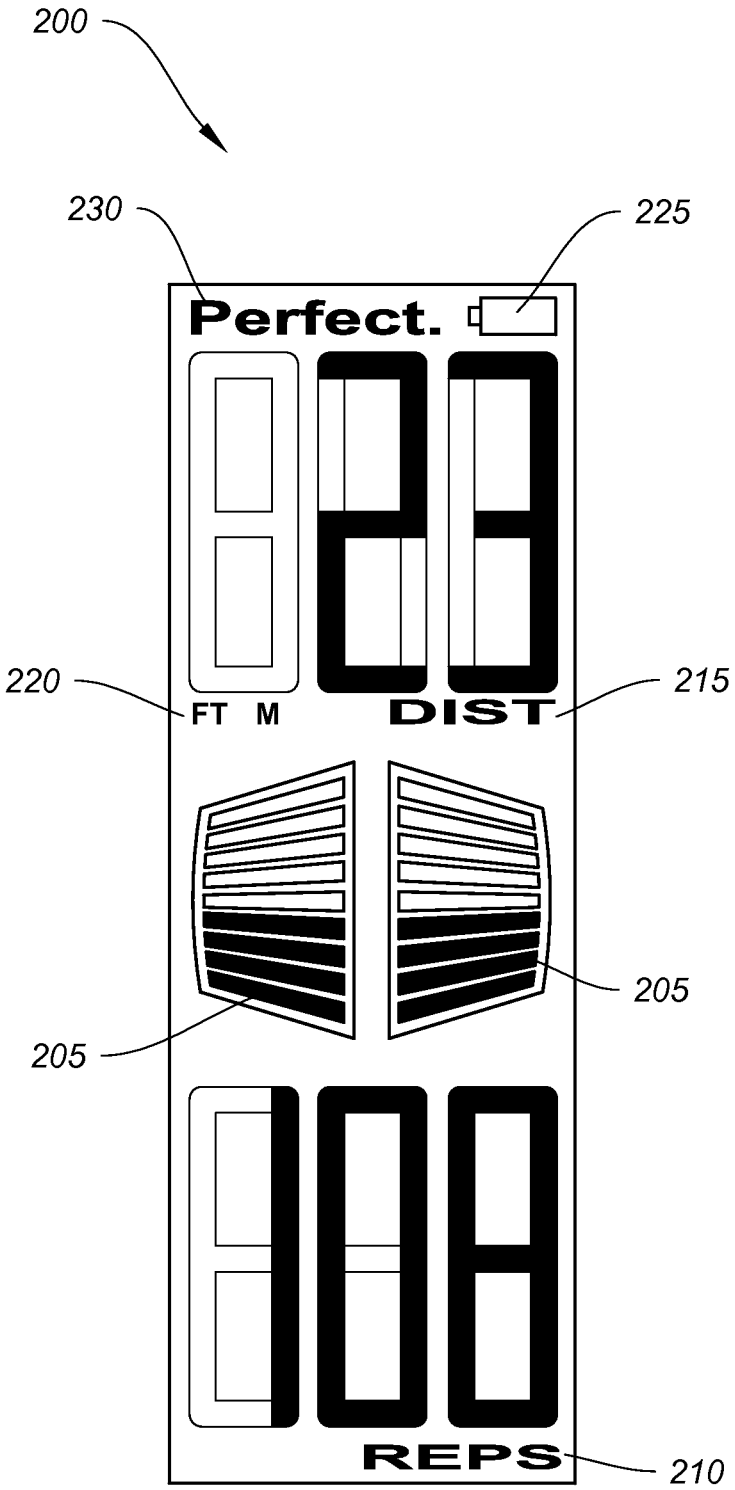
FIG. 8 is example display data output from the electronics module according to an example embodiment for review by a user during exercise.

FIG. 8 is example display data output from the electronics module according to an example embodiment for review by a user during exercise. Whether or not the display is a back lit LED/LCD within aperture 198, or provided via a projection unit within aperture 198 onto the display band 101, the module 190 can provide various system and/or workout data to the user. Referring to FIG. 8, this data may include, but is not limited to the following: (i) status of left/right tilt/carving 205; (ii) current progress and/or repetitions 210; (iii) repetition/distance descriptors 215/220; (iv) power status 225; and (v) branding 230. Other display data may include exercise metrics during workout (standard or metric), training scenarios/programs, data from past training runs and current user data (heart rate, % body fat, etc.).

Figure 9:
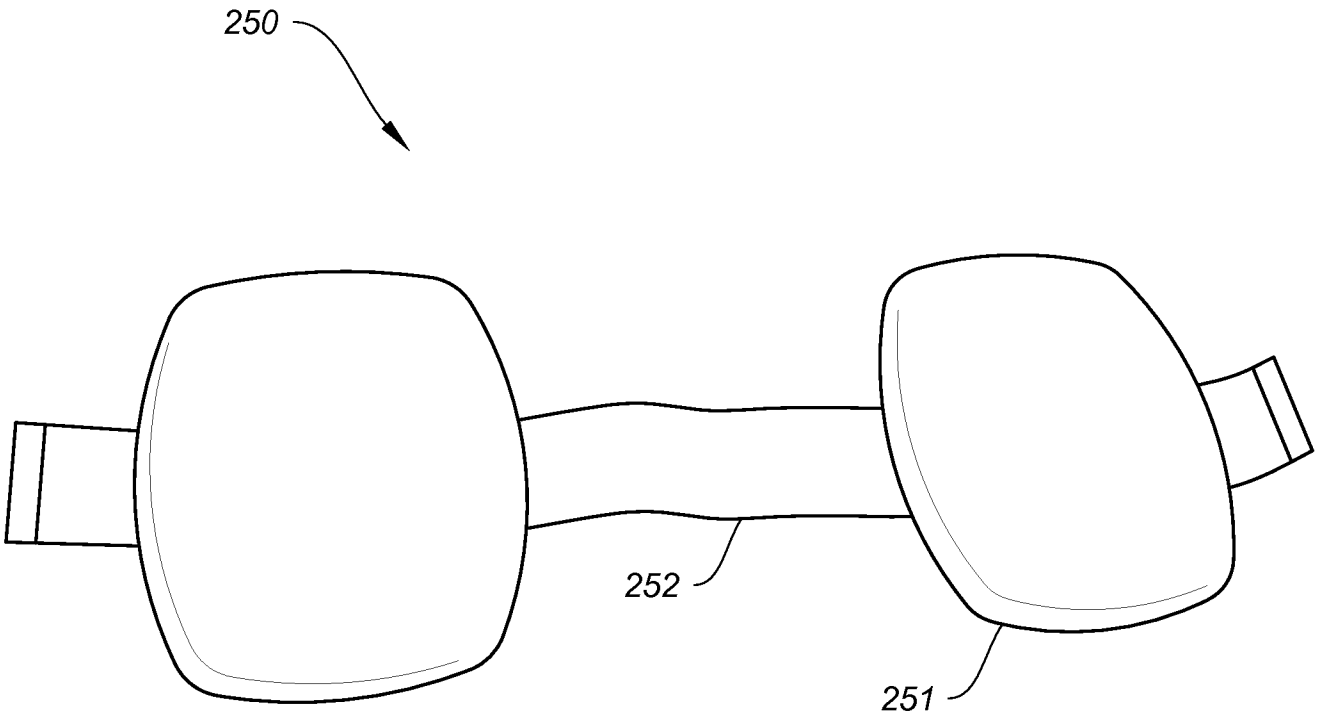
FIG. 9 is a top view of a knee pad accessory for use with the device according to an example embodiment.

FIG. 9 is a top view of a knee pad accessory for use with the device according to an example embodiment. The knee pad accessory 250 may include a pair of form pads 251 connected by a material strip 252. A user may employ the kneel pad accessory 250 between a hard surface and their knees to provide comfort and support thereto while exercising with device 100

Figure 10:
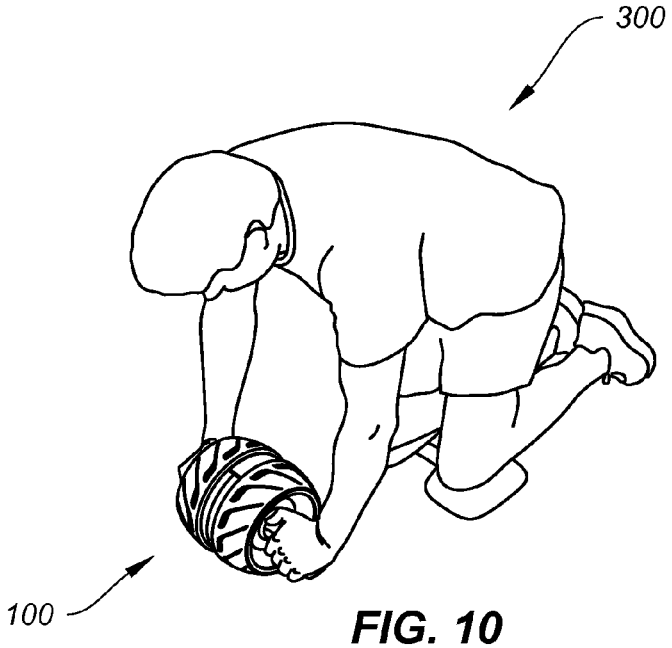
FIG. 10 is an illustration of a user operation with the device in the rest position.
Figure 11:
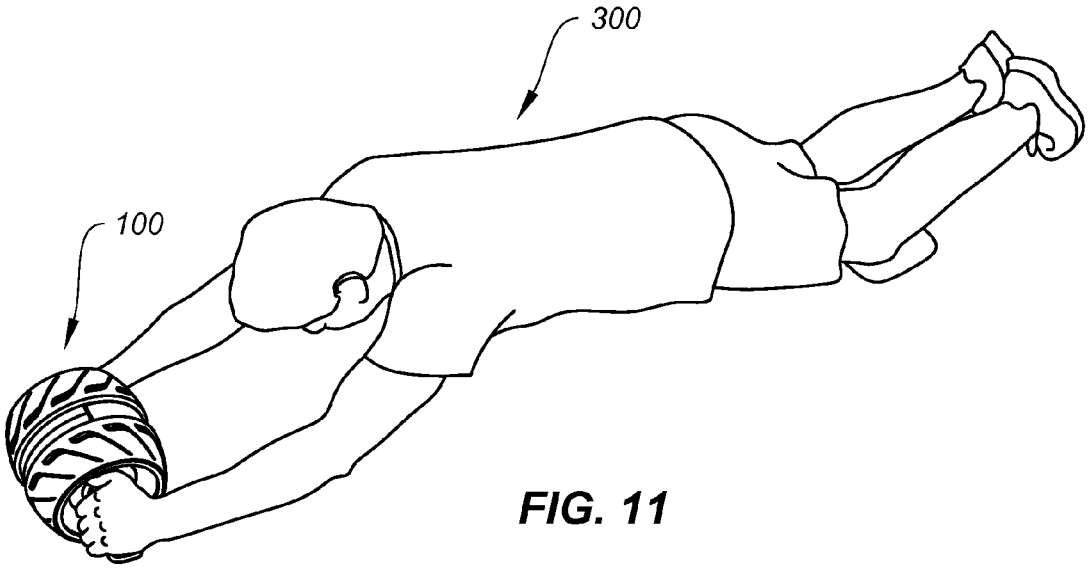
FIG. 11 is an illustration of a user operation with the device in an example exercise position.

FIG. 10 is an illustration of a user operation with the device in the rest position; and FIG. 11 is an illustration of a user operation with the device in an example exercise position. In FIG. 10, the user 300 is at rest on the knee pad accessory 250 with both hands placed on the handles of device 100. In FIG. 11, the user is shown extending outward in a straight out abdominal exercise, it being understood that the user could "carve" left or right to work left/right abdominal/oblique regions. In this embodiment, the device 100 is shown without manual actuators 129, 130 on the wheel facings 127; in this embodiment there is no clutch mechanism at all in device 100. Rather, frictional resistance is imparted to forward wheel 103 movements by an internal resistance mechanism which may include a tension spring such as one or more springs 138A, 138B shown in FIGS. 3-5, which are coupled between the axle 140 and one or both wheel parts 103A/B.

Figure 12:
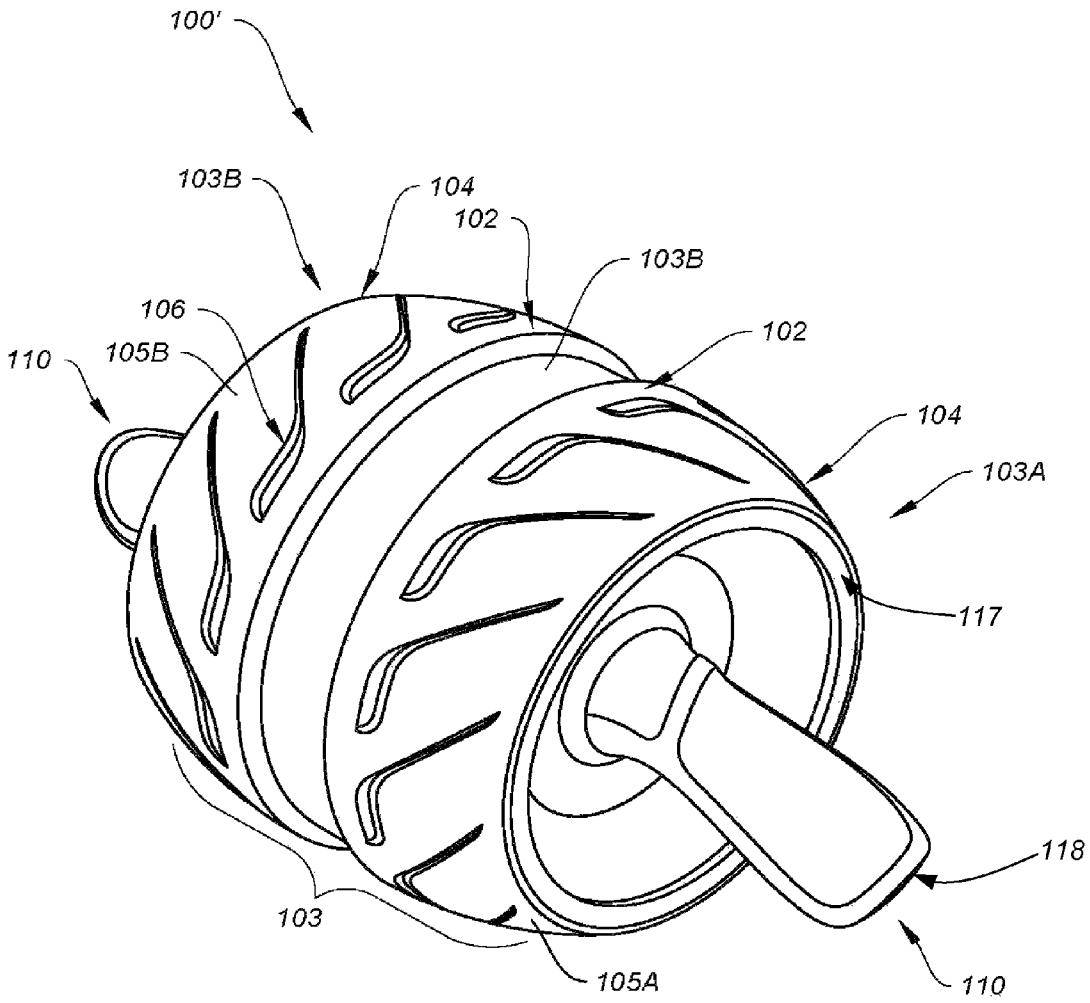
FIG. 12 is a front perspective view of a wheeled exercise device in accordance with another example embodiment.

FIG. 12 is a front perspective view of a wheeled exercise device in accordance with another example embodiment. The elements shown in FIG. 12 are similar to that shown in FIGS. 1-3; only the differences are noted in detail for purposes of brevity. The device 100' includes no central see-through display band, nor internal clutch with manual actuators 129/130. Rather, center band part forms part of right wheel part 103B (alternately it could form part of left wheel part 103A). Like FIG. 1, each wheel part 103A and 103B has a flat surface portion 102 that abuts the edge of the center band part, and a carving surface 104 that falls over toward each far edge, to provide a wide profile which is designed to mimic that of a "fat motorcycle tire" and also to aid in stability. Each wheel part 103A/B includes a corresponding tire overmold 105A, 105B with treads 106 formed therein.

Unlike the embodiment of FIGS. 1-3, device 100' includes no electronics module 190. Each handle 110 is oriented downward from a central axis of each wheel part 103A/B as in FIGS. 1-3. The downward, outward orientation of the handles 110 may reduce the stresses imparted to the wrists and shoulders during abdominal or core exercises when using the device 100'. Additionally, the distal end of each handle 110 terminates in a ridge 118. The ridge 118 serves to bound the user's hand on the handle 110 to prevent the hand from sliding sideways off of the handle 110.

Device 100' (as in FIGS. 10 and 11) includes no clutch 133A/B as shown in FIGS. 3-5. Instead, an internal resistance mechanism (against forward rotation of the center wheel 103) is built into device 100'. The resistance mechanism may be embodied as one or more springs (such as 138A or 138B) coupled between the axle 140 and a wheel part 103A/103B to impart a constant frictional resistance to rotation of one or both wheel parts 103A/B.

Figure 13:
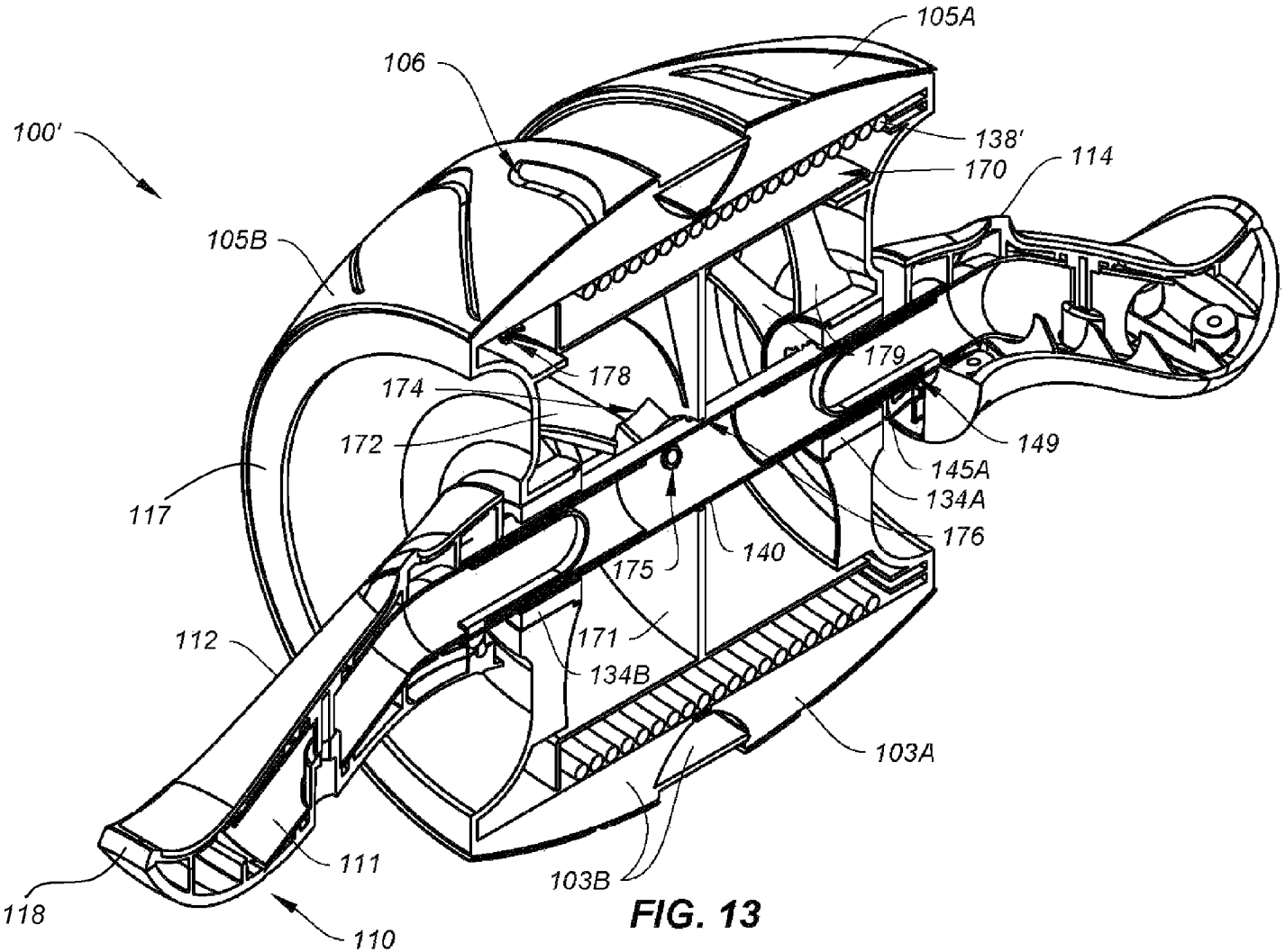
FIG. 13 is a cross-sectional cutaway of the device of FIG. 12 to illustrate the internal resistance mechanism in more detail.

FIG. 13 is a cross-sectional cutaway of the device of FIG. 12 to illustrate the internal resistance mechanism in more detail. The interior of device 100' includes a resistance mechanism comprised of a spring 138' coupled around the outside of a hub 170. Hub 170 is connected to the axle 140 and hence remains fixed with axle 140 and handles 110 during rotation of the mail wheel 103. The main wheel 103 is composed of left wheel part 103A and right wheel part 103B, inclusive of the center tab part. As in previous embodiments, each wheel part 103A/B (save for the center tab part of 103B) includes a tire overmold 105A/B with treads 106. Alternatively, parts 103A and 103B with its center tab part could be formed from a single molded piece as a main wheel 103, with overmold trim parts 105A/B applied thereon.

The hub 170 includes a vertical central rib 171 and side horizontal ribs 172 for structural support. A pin 175 attaches the hub 170 to axle 140 via element 174 having a threaded bore therein. Catches 176 on vertical rib 171 help secure and align the axle 140 to hub 170 so that pin 175 aligns into the bore of element 174. One end of spring 138' is attached to the hub 170 via a fixed, friction washer 178. The other end of the spring 138B is attached to a wheel part 103A/B (not shown).

As the device 100' is rotated in the forward direction during exercise, the spring 138' rotates out to compress down on the hub 170 to impart resistance against the forward main wheel 103 rotations. The hub 170 prevents spring 138' from compressing beyond a certain point during forward rotation which would cause the spring 138' to become over-twisted and deformed. As a user rolls the device 100' in the reverse direction back to the original position during exercise, the spring 138' is prevented from becoming bound up; specifically, the interior ribs 179 on the inside facing of the wheel parts (shown on left wheel facing 103A in FIG. 13) stop the spring 138' and maintain coil alignment on hub 170 in the reverse direction.

Moreover, and as previously discussed with respect to FIGS. 4 and 5, since the spring 138' stores potential energy as it flexes in the forward direction, this energy is released when the device is rolled in the reverse direction back to the original position of the exercise, providing a restoring or assistive force to aid the exerciser back to the starting position. Thus, the resistance mechanism can be said to impart resistance to rotation of the main wheel 103 during exercise in one direction (i.e., forward direction), but provide assistance to the exerciser in another (i.e., the opposite or reverse) wheel direction.

FIG. 13 additionally shows the relation of the handle locks 145A/B within the axle 140 and handle tubes 111 of the handles 110. Also shown is the aforementioned spring—biased detent 149 that captures the bore 119 formed in the corresponding handle tube part 111 to lock the handle tube part 111 to the handle lock 145A/B and hence axle 140. The detent 149 is configured as a spring clip with ball that extends through the bore 119 to lock the handle 110 in place on its tube 111.

The example embodiments being thus described, it will be obvious that the same may be varied in many ways. Such variations are not to be regarded as departure from the example embodiments, and all such modifications as would be obvious to one skilled in the art are intended to be included in the following claims.

We claim:

1. A wheeled exercise device configured to be rolled on a ground surface by a user for exercise, comprising:

a single wheel having a generally wide width profile for rolling along the ground surface for exercise, the wheel having an interior cavity bounded by wheel side surfaces with central openings in each wheel side surface, an elongate central axle provided within the interior cavity of the wheel between the two openings in the wheel side surfaces and extending along a central horizontal axis through the wheel that is parallel to the ground surface, a pair of elongate handles coupled to the central axle, each handle having a proximal end and distal end, one handle on either wheel side surface thereof attached at its proximal end to the central axle at a corresponding central opening, each elongate handle oriented at an angle to the horizontal central axis through the wheel so that the handle extends outward from its wheel side surface and downward relative to the central horizontal axis of the wheel toward the ground surface, each elongate handle further including an upper elongate surface and a lower elongate surface between its proximal and distal ends, the upper and lower surfaces each oriented at an angle to the horizontal central axis through the wheel so that a substantial length portion of each of the upper and lower surfaces extends away from its wheel side surface and downward toward the ground surface, below the central horizontal axis while a user is performing a rolling exercise on said ground surface, each handle includes a distinct ergonomically formed hump located on an upper surface thereof at a distance closer to where the handle meets the central axle than said distal end of the handle, the ergonomic hump adapted for separating the user's thumb from the other fingers of the user's hand on the handle, and a coiled spring element arranged so as to encircle the central axle within the wheel interior cavity, the spring element imparting resistance to rotation of the wheel as the exercise device is rolled by said user placing their hands on the handles and rolling the wheel along the ground surface in a forward direction relative to a starting position of the user for exercise with the wheel, the spring element providing a restoring or assistive force to aid the user as the user rolls the wheel back along the ground surface to the user's starting position.

2. The device of claim 1, wherein the coiled spring element is attached between an inner surface of the wheel and the central axle within the interior cavity.

3. The device of claim 1, wherein one end of the coiled spring element is attached to a hub formed along the inner surface of the wheel within the interior cavity, the hub in turn attached to the central axle, and the other end of the spring element is attached to the inner surface of the wheel.

4. The device of claim 1, wherein the wheel includes a tire overmold with threads therein attached to an outer surface thereof.

5. The device of claim 1, wherein the distal end of each handle includes a ridge.

6. A wheeled exercise device configured to be rolled on a ground surface by a user for exercise, comprising:

a single wheel for rolling along the ground surface and including an interior cavity bounded by wheel side surfaces with central openings in each wheel side surface, an elongate central axle extending along a central horizontal axis through the wheel interior cavity between the two central openings in the wheel side surfaces, a pair of elongate handles coupled to the central axle, each handle having a proximal end and distal end, one handle on either wheel side surface thereof attached at its proximal end to the central axle at a corresponding central opening so as to be oriented substantially transverse to the wheel side surface, each elongate handle further including an upper elongate surface and a lower elongate surface between its proximal and distal ends, the upper and lower surfaces each oriented at an angle to the horizontal central axis through the wheel so that a substantial length portion of each of the upper and lower surfaces extends away from its wheel side surface and downward toward the ground surface, below the central horizontal axis while a user is performing a rolling exercise on said ground surface, each handle includes a distinct ergonomically formed hump located on an upper surface thereof at a distance closer to where the handle meets the central axle than said distal end of the handle, the ergonomic hump adapted for separating the user's thumb from the other fingers of the user's hand on the handle.

7. The device of claim 6, wherein the wheel includes a tire overmold with threads therein attached to an outer surface thereof.

8. The device of claim 6, wherein the distal end of each handle terminates in a ridge.

9. The device of claim 6, wherein the wheel has a generally wide width profile for rolling along the ground surface for exercise, the wheel configured to be carved back and forth along the ground surface so that the wheel travels in a forward/backward to left direction and a forward/backward to right direction, in addition to being rolled directly forward from and backward to the user.

10. The device of claim 6, further comprising:

a spring element provided within the interior cavity of the wheel and connected between the wheel and central axle, the spring element imparting resistance to rotation of the wheel as it is rolled by a user for exercise along the ground surface in a forward direction relative to a starting position of the user, the spring element providing a restoring or assistive force to aid the user as the user rolls the wheel back along the ground surface to the user's starting position.

* * * * *